US005540611A

United States Patent [19]

Lapoint et al.

[11] Patent Number: 5,540,611

[45] Date of Patent: Jul. 30, 1996

[54] AIR ACTUATED FLEXIBLE BEVERAGE CONTAINER COVER

[76] Inventors: Brian Lapoint, 53 Jerdens La., Rockport, Mass. 01966; Ross Bennett, 204B W. McDermott Dr., Allen, Tex. 75002

[21] Appl. No.: 523,234

[22] Filed: Sep. 5, 1995

[51] Int. Cl.[6] ..... A63H 3/04

[52] U.S. Cl. ..... 446/72; 446/74; 446/199; 446/200; 215/229

[58] Field of Search ..... 220/705, 709, 220/710, 287, 376; 215/229, 388, 389, 319; 446/72, 74, 199, 200

[56] References Cited

U.S. PATENT DOCUMENTS

| | | | |
|---|---|---|---|
| 2,544,594 | 3/1951 | Goldfarb . | |
| 2,546,122 | 3/1951 | Goldfarb . | |
| 2,731,751 | 1/1956 | Green | 41/10 |
| 3,009,594 | 11/1961 | Anson | 215/48 |
| 3,172,561 | 3/1965 | Schwartz | 220/709 |
| 3,285,584 | 11/1966 | Goldfarb | 446/74 |
| 3,606,074 | 9/1971 | Hayes | 220/42 |
| 3,782,028 | 1/1974 | Kelly . | |
| 3,879,885 | 4/1975 | Fabricant . | |
| 4,153,170 | 5/1979 | Auarian | 215/388 |
| 4,542,833 | 9/1985 | DeVaughn | 215/319 |
| 4,901,881 | 2/1990 | McElroy | 215/229 |
| 4,934,558 | 6/1990 | Vargas | 220/287 |
| 5,062,552 | 11/1991 | Heubel | 220/287 |
| 5,361,935 | 11/1994 | Saguccio . | |
| 5,393,258 | 2/1995 | Karterman | 446/71 |
| 5,454,479 | 10/1995 | Kraus | 220/287 |

*Primary Examiner*—Robert A. Hafer
*Assistant Examiner*—Jeffrey D. Carlson

[57] ABSTRACT

A hollow, flexible cover, molded in the shape of a full or partial sculpture, and designed to fit over the open end of a can, glass, cup, bottle, or carton type beverage container, and having an opening for a straw, to extend into the container to siphon liquid therefrom, such that the change in atmospheric pressure within the container, created by an intermittent siphoning of liquid, causes the cover to collapse and expand in a controlled manner and thereby exhibit animation or lifelike movement.

2 Claims, 2 Drawing Sheets

AIR ACTUATED FLEXIBLE BEVERAGE CONTAINER COVER

BACKGROUND OF THE INVENTION

1. Field of the Invention

This invention relates to decorative covers or devices, which are mounted on a beverage container to provide amusement and entertainment while drinking the beverage.

2. Prior Art

Various types of entertainment devices, for mounting on a beverage container, have become a popular means of providing amusement to children, while functioning as lid to prevent spillage. The least expensive of these devices are typically rigid plastic covers, molded in the shape of funny faces, animal heads, or whimsical characters, like those disclosed in U.S. Pat. No. 2,546,122 and U.S. Pat. No. 2,731,751. While such items are attractive, they provide little entertainment value beyond that of decorating the container.

More elaborate designs, such as those disclosed in U.S. Pat. No. 2,544,594 and U.S. Pat. No. 3,782,028 create additional amusement by incorporating features, that are driven by channeling liquid through a mechanism while drinking. Such devices present a serious sanitary problem, since small intricate pans of mechanisms are very difficult to clean after coming in contact with liquids, resulting in a bacteria laden device when reused at a later date. These items are therefore considered unacceptable for mass marketing.

U.S. Pat. No. 5,393,258 discloses a device which addresses the problem of sanitation by incorporating a mechanism, that is driven by air instead of liquid. Solutions such as this have been proven insufficient since contamination of the mechanism still occurs, if the beverage container is tipped or the user blows into the straw.

The need exists for a beverage container cover, that will provide, not only amusement because of its decorative nature, but also entertainment through animation, without the need for costly, complex mechanisms or concern over adequate sanitation.

SUMMARY OF THE INVENTION

This invention is concerned with providing a hollow, flexible cover, molded in the shape of a full or partial object or character sculpture, with a base that is designed to fit over the open end of a can, glass, cup, bottle, or carton type beverage container. A small hole thru the cover is designed to provide a snug fit for a straw extending into the container to siphon liquid therefrom. As an intermittent sipping of liquid ensues, a fluctuation in atmospheric pressure within the container causes the cover to collapse and expand in a controlled and predetermined manner, resulting in a lifelike animation or movement.

It is therefore one object of this invention to provide an operative result, where inoperability has existed.

It is a further object of this invention, to provide an animatable beverage container cover which incorporates no mechanical assembly of separately manufactured components.

It is another object of this invention to provide an animatable beverage container cover, that is less expensive to manufacture than prior designs offering movement.

It is a further object of this invention to provide an animatable beverage container cover, which is easy to clean, requiring no disassembly.

Other objects and advantages of this invention will become apparent from a consideration of the drawings and ensuing description.

DETAILED DESCRIPTION OF THE INVENTION

Figure 1:
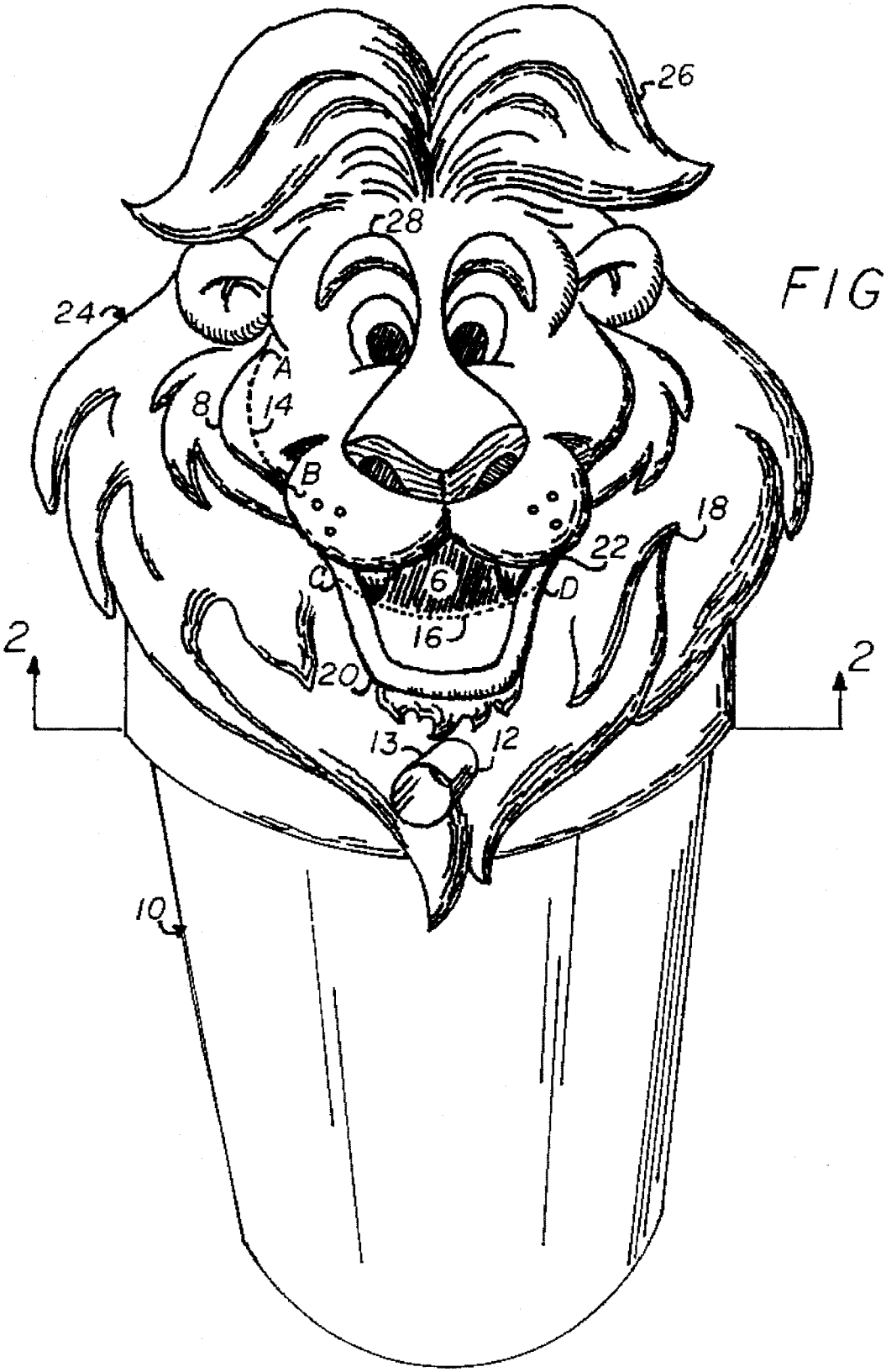
FIG. 1 Is a perspective view of the preferred embodiment of the invention as molded in a shape of a partial sculpture viewed from above.

In the preferred embodiment, FIG. 1 discloses a hollow cover 24 designed to fit over the open end of a beverage container 10. Cover 24 is either rotationally or injection molded, from a soft and pliable material such as vinyl, silicone or latex utilizing processes well known within the plastics industry.

The movement of cover 24 facial features, is determined by the placement of hinges, when the character head is sculpted. Hinges are created by sculpting cuts or undercuts, around the prominent features where animation is desired; The deeper the cuts are sculpted, the more effective will be the hinge. For example, cheek 8 will move in and out, while sipping liquid thru a straw 13 inserted into port 12, or expand outward, when air is blown into container 10 thru straw 13, because of a hinge 14, which extends from a point A to a point B.

In another example, lower jaw 20 will open and close while sipping liquid thru straw 13, because an undercut hinge 16, which extends from a point C to a point D, will allow lower jaw 20 to move towards upper jaw 22, when a drop in atmospheric pressure within container 10 causes throat area 6 to be pulled into container 10. If air is blown into container 10 thru straw 13, lower jaw 20 will move away from upper jaw 22 pivoting on hinge 16, because an increase in atmospheric pressure within container 10 causes throat area 6 to be forced outward.

Features of cover 24 that are concave, such as mane 26 or convex, such as eyebrow 28 and have no boardering hinges, tend to move little or not at all, and areas containing details that render the surface of cover 24 irregular, such as mane 18, are the most stable tending not to move.

Figure 2:
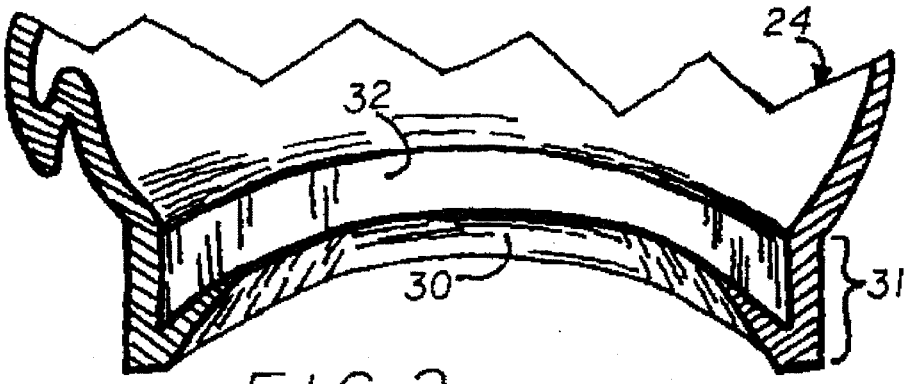
FIG. 2 Is a vertical cross-sectional view of a portion of FIG. 1 taken on the line 2—2 with the beverage container removed to show detail.

Referring now to FIG. 2, there is disclosed a vertical cross-sectional view, of a portion of FIG. 1 taken on the line 2—2, showing the inside detail of the base 31 of cover 24. An inwardly angled flap 30 achieves a fit, that is not sloppy or loose, with a range of beverage container sizes, by expanding outwards and approaching a parallel orientation with vertical wall 32, when cover 24 is fit over the open end of an appropriate size beverage container.

Figure 3:
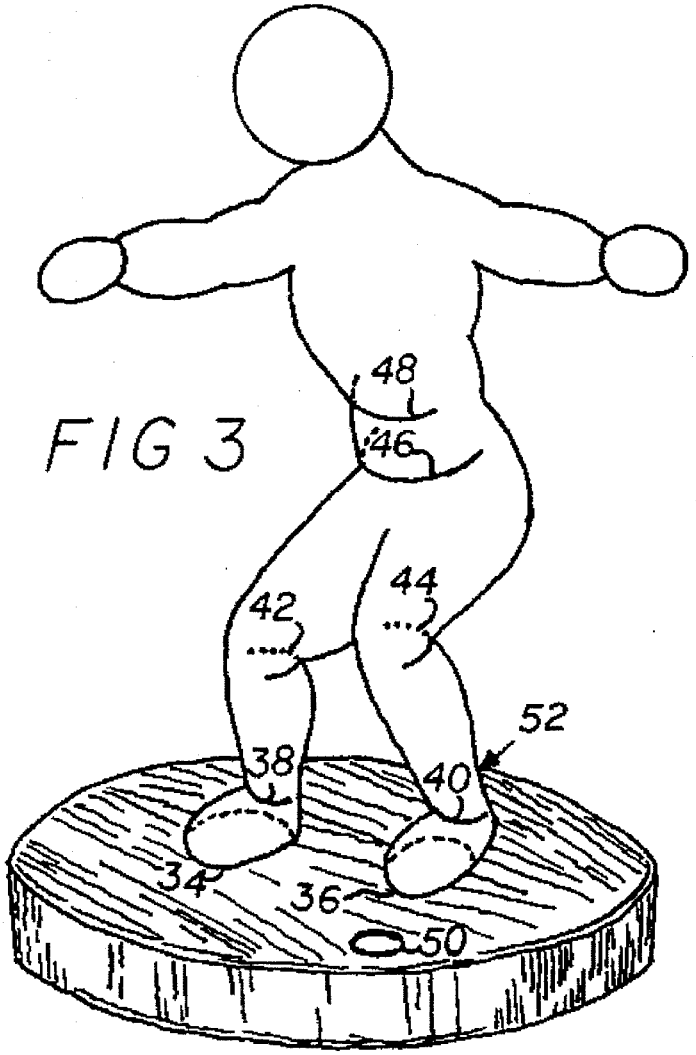
FIG. 3 Is a perspective view of the invention as molded in a shape of a full sculpture viewed from above.

As disclosed in FIG. 3, a flexible beverage container cover 52 can be molded in the shape of a full character sculpture. The area beneath foot 34 and 36 is open to allow air in flow in and out of the character's hollow body. Hinges 38, 40, 42, 44, 46 and 48 work together to produce a dance like animation or movement when liquid is intermittently sipped from, or air is intermittently blown into, a beverage container thru a straw properly inserted into port 50 with cover 52 properly seated over the open end of aforesaid beverage container.

What is claimed as new and desired to be secured by Letters Patent is:

1. A flexible beverage container cover comprising:

a body having a base portion and a sculpture portion, said sculpture portion including a hollow flexible sculpture made of soft pliable material of a predetermined thickness, said sculpture resembling an animate creature; said base being provided with a means for tightly mounting to a beverage container; said sculpture portion being provided with a straw port so that a drinking straw may be tightly received by said port; said sculpture including prominent decorative features and having areas of reduced thickness in the pliable material adjacent said features; whereby a straw may be snugly received in said port and said cover may be snugly attached to a beverage container and whereby suction provided to the straw results in the formation of a vacuum sufficient to collapse said sculpture at said areas of reduced thickness, such collapsing providing amusing animation to the prominent features of the creature.

2. The flexible beverage container cover of claim 1, wherein said means for mounting includes a circular opening with an inwardly extending and tapered flange such that said cover may be tightly mounted to beverage containers of various size.

* * * * *